US006300277B1

(12) United States Patent
Miyauchi et al.

(10) Patent No.: US 6,300,277 B1
(45) Date of Patent: Oct. 9, 2001

(54) THERMOSENSITIVE RECORDING MATERIAL

(75) Inventors: Shinobu Miyauchi, Numazu; Takahide Kutsuma, Shizuoka-ken, both of (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/339,645

(22) Filed: Jun. 24, 1999

(30) Foreign Application Priority Data

Jul. 9, 1998 (JP) ..... 10-194471

(51) Int. Cl.[7] ..... B41M 5/30
(52) U.S. Cl. ..... 503/200; 503/201; 503/226
(58) Field of Search ..... 503/200, 201, 503/226

(56) References Cited

U.S. PATENT DOCUMENTS 4,459,336 7/1984 Miyakawa ..... 346/208
5,703,006 12/1997 Y. Mori et al. ..... 503/207
6,060,427 * 5/2000 Mori et al. ..... 503/200

FOREIGN PATENT DOCUMENTS 0552065 7/1993 (EP) .

* cited by examiner

*Primary Examiner*—Bruce H. Hess
(74) *Attorney, Agent, or Firm*—Cooper & Dunham LLP

(57) ABSTRACT

A thermosensitive recording material including a coloring layer which is formed overlying a substrate and which includes a leuco dye and a color developer which can make the leuco dye color upon application of heat, wherein the thermosensitive recording material has a thermal property such that the coloring layer achieves a colored state having an image density (1) not less than about 1.20 when the coloring layer is heated with a thermal printhead upon application of a recording energy of 0.45 mJ/dot, and the coloring layer achieves a colored state having an image density (2) which is not less than about 0.1 lower than the image density (1) when the coloring layer is heated by being brought into contact with a heated block at a temperature of 150° C. for 1 second upon application of a pressure of 2 kg/cm$^2$.

12 Claims, 1 Drawing Sheet

THERMOSENSITIVE RECORDING MATERIAL

BACKGROUND OF THE INVENTION

1. Field of the Invention

The present invention relates to a thermosensitive recording material, and more particularly to a thermosensitive recording material in which image information formed therein with a thermal printhead can be read even when the recording material having the image is accidentally heated with a heat source and the like.

2. Discussion of the Related Art

Currently, with the diversification of information and needs, various information recording materials have been researched and developed for commercial operation in information recording fields. Under such circumstances, recording materials are used not only for information recording and transmitting, but also as the likes of notes such as lottery tickets. Recording materials for use in the lottery tickets have to have good reliability. Therefore image information in lottery tickets is typically recorded by printing. When a need exists for additional writing of new image information in a lottery ticket on demand, images are recorded by a method such as wire dot printing, laser printing and thermal transfer recording because the images recorded by these printing methods have good reliability such that the images cannot be easily erased.

However, these printing methods have the following drawbacks:

(1) since having complex printing process and mechanism, these printing methods have to use a large printing apparatus;

(2) one or more supplies such as ribbons and toners are needed other than a receiving material, resulting in high running cost; and (3) it is troublesome to change the supplies such as ribbons and toners.

Therefore, persons handling the likes of notes in which images are recorded by one of these methods on demand suffer much inconvenience.

Thermosensitive recording materials, which have been used for recording materials for computers, cash registers, calculators, facsimiles, ticket vending machines, measuring instruments, copiers and label printers, have the following advantages:

(1) images can be easily recorded by such a simple method that a recording material is imagewise heated;

(2) a small-sized printing apparatus can be used; and (3) recording materials are low-priced and easy to handle. Therefore, it is possible to improve the above-mentioned drawbacks of the methods such as wire dot printing, laser printing and thermal transfer recording by using thermal recording materials.

However, thermal recording materials have a drawback in that when images formed in a thermosensitive recording material accidentally contacts a heat source, the images become unreadable. This is because the non-colored area of the recording material which surrounds the images achieves a colored state which has substantially the same color and image density as those of the images when heated by the heat source. This trouble also occurs when a heat source closely approaches the image instead of contacting the image.

In attempting to improve the reliability of images formed in thermosensitive recording materials, various methods have been proposed, however, there is no thermosensitive recording material which can produce images which are readable when the images are heated at a relatively high temperature. In detailed description, these methods have proposed thermosensitive recording materials which have a heat resistance such that images formed therein can be read when the recording materials having the images are stored in such a high temperature place as warehouses, automobiles and the like in a summer season. The temperature of warehouses and automobiles in a summer season is from about 60 to about 90° C. However, there is a possibility that the likes of notes such as lottery tickets are accidentally heated at a relatively high temperature of from 100 to 150° C. compared to the case mentioned above, for example, by being accidentally ironed or contacted with boiled water and the like. There is no thermosensitive recording material suitable for this use because it is considered to be difficult to improve thermosensitive recording materials so as to have such high heat resistance.

Thermosensitive recording materials are practically and widely used for lottery tickets in some countries other than Japan because of the advantages mentioned above. The thermosensitive recording materials, which are practically used for lottery tickets in the countries, have poor heat resistance such that when the recording materials are heated at a temperature of from about 100 to about 150° C., the recording materials color black and therefore the previously recorded images become unreadable. In these countries, when a person requests to cash a winning lottery ticket, which colors by being accidentally heated, the conversion into cash is refused due to the reason that he is careless in management of the ticket. In Japan, in such a case, if it is identified that the ticket is a winning ticket, the ticket will be converted to cash. However, in Japan thermosensitive recording materials are not practically used for lottery tickets because of having the drawback mentioned above, whereas the recording materials have the many advantages mentioned above.

Because of these reasons, a need exists for a thermosensitive recording material having good heat resistance such that images formed therein can be read even when accidentally heated to a temperature of from 100 to 150° C.

SUMMARY OF THE INVENTION

Accordingly, an object of the present invention is to provide a thermosensitive recording material having good heat resistance such that images formed therein can be read even when the images are accidentally heated with a heat source.

Another object of the present invention is to provide a thermosensitive recording material which is useful for the likes of notes such as lottery tickets.

To achieve such objects, the present invention contemplates the provision of a thermosensitive recording material including a coloring layer which is formed overlying a substrate and which includes a leuco dye and a color developer which can make the leuco dye color upon application of heat, wherein the thermosensitive recording material has a thermal property such that the coloring layer achieves a colored state having an image density (1) not lower than about 1.20 when the coloring layer is heated with a thermal printhead upon application of a recording energy of 0.45 mJ/dot, and the coloring layer achieves a colored state having an image density (2), which is not less than about 0.1 lower than the image density (1), when the coloring layer is heated by being brought into contact with a heated block at a temperature of 150° C. for 1 second upon application of a pressure of 2 kg/cm$^2$.

The image density (1) is preferably not lower than about 1.35.

Preferably, the thermosensitive recording material further has a thermal property such that the coloring layer achieves a colored state having an image density (3) not lower than about 1.00 when the coloring layer is heated by being brought into contact with a heated block at a temperature of 140° C. for 1 second upon application of a pressure of 2 kg/cm$^2$.

Preferably, the thermosensitive recording material further has an intermediate layer which is formed between the substrate and the coloring layer and which includes an organic hollow filler having a volume average particle diameter of from about 1 to about 10 $\mu$m and a hollow rate of from about 60 to about 98%.

These and other objects, features and advantages of the present invention will become apparent upon consideration of the following description of the preferred embodiments of the present invention taken in conjunction with the accompanying drawing.

DESCRIPTION OF THE PREFERRED EMBODIMENTS

Figure 1:
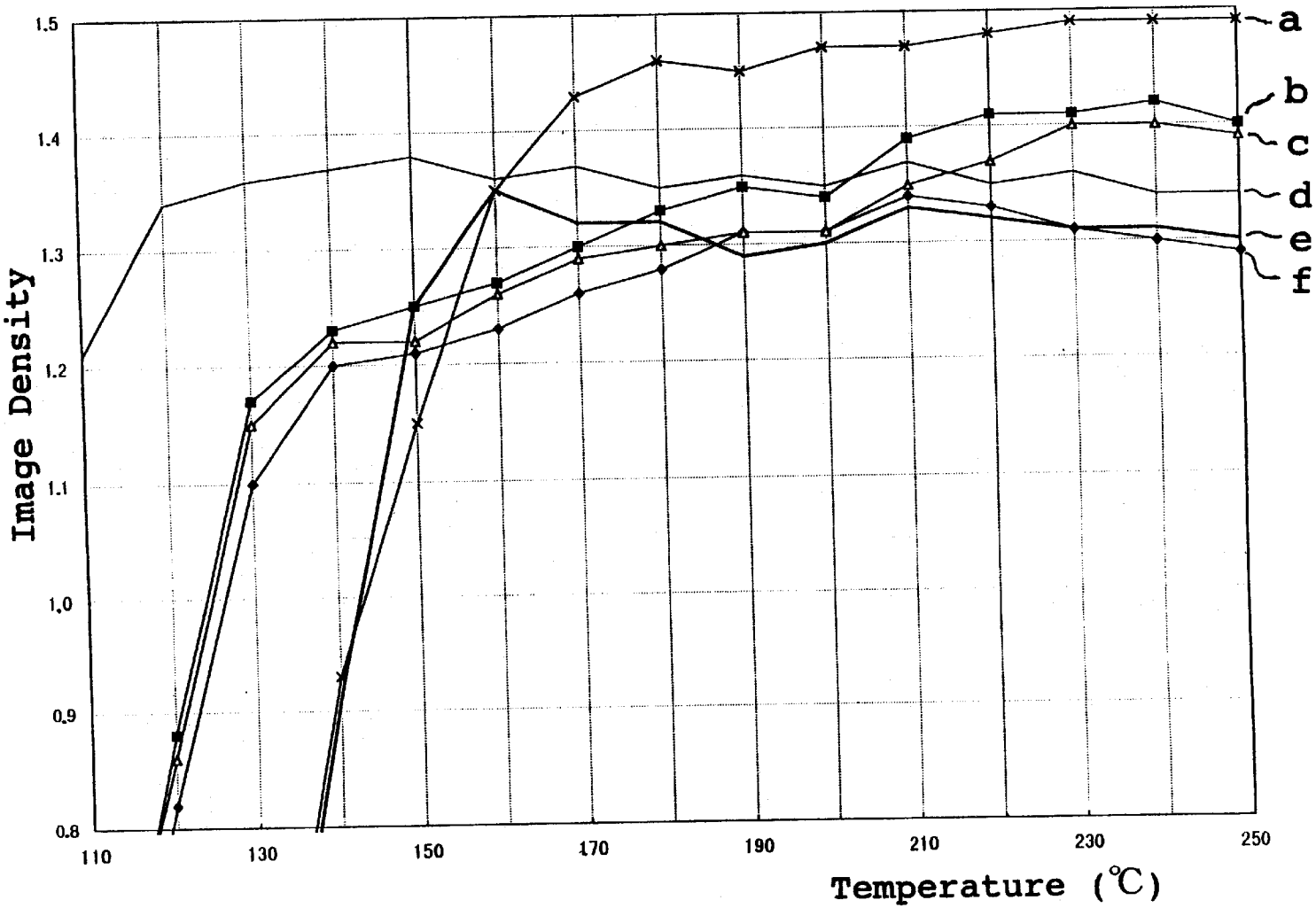
FIG. 1 is a graph illustrating thermal properties of embodiments of the thermosensitive recording material of the present invention and comparative thermosensitive recording materials.

Generally, the present invention provides a thermosensitive recording material including a coloring layer which is formed overlying a substrate and which includes a leuco dye and a color developer which can make the leuco dye color upon application of heat, wherein the thermosensitive recording material has a thermal property such that the coloring layer achieves a colored state having an image density (1) not lower than about 1.20 when the coloring layer is heated with a thermal printhead upon application of a recording energy of 0.45 mJ/dot, and the coloring layer achieves a colored state having an image density (2) which is not less than about 0.1 lower than the image density (1) when the coloring layer is heated by being brought into contact with a heated block at a temperature of 150° C. for 1 second upon application of a pressure of 2 kg/cm$^2$.

The image density (2), which is an image density when the coloring layer is heated by being brought into contact with a heated block at a temperature of 150° C. for 1 second upon application of a pressure of 2 kg/cm$^2$, almost corresponds to an image density when the thermosensitive recording material accidentally contacts a heat source such as iron.

In order to impart such a thermal property to a thermosensitive recording material, the leuco dye and/or the color developer preferably have a relatively high melting point not lower than about 180° C.

In this case, the thermosensitive recording material generally has relatively low dynamic thermosensitivity. Namely, the thermosensitive recording material produces an image having a relatively low image density when the recording material is imagewise heated with a thermal printhead whose recording heat energy is suitable for normal thermosensitive recording materials. In order to obtain an image having a good image density, a relatively high printing energy has to be applied to the recording material with a thermal printhead, and therefore the thermal printhead tends to be overloaded. Therefore, one or more of dyes and color developers, which have a melting point not greater than 180° C., are preferably mixed with the leuco dye and the color developer, which have a melting point not less than 180° C.

In addition, in order to impart a heat insulation property and an ability to securely contact thermal printheads to the recording material, the recording material preferably has an intermediate layer which is formed between the substrate and the coloring layer and which includes an organic hollow filler having a volume average particle diameter of from about 1 to about 10 $\mu$m and a hollow rate of from about 60 to about 98%.

By imparting to the recording material a thermal property such that an image recorded by heating with a thermal printhead of 0.45 mJ/dot in recording energy has an image density not lower than 1.35, the load of the thermal printhead can be decreased.

It is more preferable to impart to the recording material a thermal property such that the image density of the recording material is not lower than 1.0 when the coloring layer contacts a heated block at a temperature of 140° C. for 1 second upon application of a pressure of 2 kg/cm$^2$. By imparting such a thermal property to the recording material, the load of the thermal printhead can also be decreased.

FIG. 1 is a graph illustrating static coloring properties of a plurality of thermosensitive recording materials. In detailed description, FIG. 1 illustrates the relationship between a temperature (°C., plotted on the horizontal axis) and an image density (plotted on the vertical axis) of a recording material when heated to the temperature. In FIG. 1, the thermosensitive recording materials of lines a, b and c are of the present invention and the thermosensitive recording materials of lines d, e and f are comparative recording materials. This is because the difference between the color densities at 150° C. and 200° C. is greater than 0.1 in the recording materials of lines a, b and c, and the difference is less than 0.1 in the recording materials of lines d, e and f. At this point, the image density of images recorded by a thermal printhead with a recording energy of 0.45 mJ/dot almost corresponds to the image density of the recording material when the recording material is heated at a temperature of 200° C. or more.

These thermosensitive recording materials of the present invention can be prepared by appropriately combining one or more coloring agents (leuco dye) and color developers and adding a proper amount of one or more suitable additives to the coloring layer.

The thermosensitive recording material of the present invention has a substrate and a coloring layer, and preferably has an intermediate layer which is formed between the substrate and the coloring layer. The thermosensitive recording material of the present invention optionally has a protective layer which is formed overlying the coloring layer. In the present invention, a pigment is preferably included in one or more of the layers to impart an excellent combination of a high dynamic thermosensitivity and a good heat resistance to the recording material. Suitable pigments for use in the thermosensitive recording material of the present invention include inorganic or organic pigments having an oil absorption of from about 130 to about 200 ml/100 g to prepare a recording material having a good concealing effect and good thermosensitivity and to prepare a coating liquid for these layers having good coating properties, which contains one or more of the pigments. By including such a pigment in the coloring layer, the resultant recording material having a good concealing effect, and when the recording material is brought into contact with a heat source, the melted and colored dyes and color developer are absorbed in the pigment, thereby controlling the image density so as to be relatively low.

When such a pigment is included in the coloring layer, the preferred content of the pigment is from 3 to 6 parts by weight per 1 part by weight of the leuco dye included therein to prepare a thermosensitive recording material having good thermosensitivity and good heat resistance.

Among such inorganic or organic pigments for use in the recording material of the present invention, silica is particularly preferable. Other pigments can be used in combination with silica to adjust the oil absorption of the pigments added. Suitable pigments for use as the pigment other than silica include auxiliary components mentioned later such as inorganic or organic fillers.

Suitable leuco dyes for use in the coloring layer include known leuco dyes, which are used as a coloring agent in the coloring layers of conventional thermosensitive recording materials, such as triphenyl methane type leuco dyes, fluoran type leuco dyes, phenothiazine type leuco dyes, auramine type leuco dyes, spiropyran type leuco dyes, indolinophthalide type leuco dyes and the like.

Specific examples of such leuco dyes include:

3,3-bis(p-dimethylaminophenyl)-phthalide,
3,3-bis(p-dimethylaminophenyl)-6-dimethylaminophthalide (i.e., Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-N-methyl-N-isobutyl-6-methyl-7-anilinofluoran,
3-N-ethyl-N-isoamyl-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthyl] benzoic acid lactam,
3-diethylamino-6-methyl-7-(m-trichloromethylanilino) fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4',-dimethylanilino)fluoran,
3-(N,N-diethylamino)-5-methyl-7-(N,N-dibenzylamino) fluoran, benzoyl leuco methylene blue,
6'-chloro-8'-methoxybenzoindolino-spiropyran,
6'-bromo-3'-methoxybenzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morphorino-7-(N-propyl-trifluoromethylanilino)fluoran,
3-pyrrolidino-7-trifluoromethylanilinofluoran,
3-diethylamino-5-chloro-7-(N-benzyltrifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino) fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino) fluoran,
3-(N-methyl-N-isopropylamino)-6-methyl-7-anilinofluoran,
3-dibutylamino-6-methyl-7-anilinofluoran,
3-dipentylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesidino-4',5'-benzofluoran,
3-(p-dimethylaminophenyl)-3-[1,1-bis(p-dimethylaminophenyl)ethylene-2-yl]phthalide,
3-(p-dimethylaminophenyl)-3-[1,1-bis(p-dimethylaminophenyl)ethylene-2-yl]-6-dimethylaminophthalide,
3-(p-dimethylaminophenyl)-3-(1-p-dimethylaminophenyl-1-phenylethylene-2-yl)phthalide,
3-(p-dimethylaminophenyl)-3-(1-p-dimethylaminophenyl-1-p-chlorophenylethylene-2-yl)-6-dimethylaminophthalide,
3-(4'-dimethylamino-2'-methoxy)-3-(1-p-dimethylaminophenyl-1-p-chlorophenyl-1,3-butadiene-4-yl)benzophthalide,
3-(4'-dimethylamino-2'-benzyloxy)-3-(1-p-dimethylaminophenyl-1-phenyl-1,3-butadiene-4-yl) benzophthalide,
3-dimethylamino-6-dimethylamino-fluoren-9-spiro-3'-(6'-dimethylamino)phthalide,
3,3-bis[2-(p-dimethylaminophenyl)-2-(p-methoxyphenyl) ethenyl]-4,5,6,7-tetrachlorophthalide,
3-bis[1,1-bis(4-pyrrolidinophenyl)ethylene-2-yl]-5,6-dichloro-4,7-dibromophthalide,
bis(p-dimethylaminostyryl)-1-naphthalenesulfonylmethane,
bis(p-dimethylaminostyryl)-1-p-tolylsulfonylmethane, and the like.

These leuco dyes can be employed alone or in combination.

Suitable color developers for use in the coloring layer include known electron acceptors, which can react with the above-mentioned leuco dyes by contact to induce color formation, such as phenolic compounds, thiophenolic compounds, thiourea derivatives, organic acids and their metal salts, and the like. The content of the color developer is controlled so that the image density of the recording material when heated by being brought into contact with a heated block at a temperature of 150° C. is 0.1 or more lower than the maximum image density of the recording material.

Specific examples of such color developers include:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol, 4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methyl)phenol,
4,4'-diphenolsulfone,
4-isoproxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoic acid,
2-hydroxy-1-naphthoic acid,
1-hydroxy-2-naphthoic acid,
hydroxy naphthoic acid metal salts such as zinc, aluminum or calcium,
bis-(4-hydroxyphenyl)acetic acid methyl ester,
bis-(4-hydroxyphenyl)acetic acid benzyl ester,
1,3-bis(4-hydroxycumyl)benzene,
1,4-bis(4-hydroxycumyl)benzene,
2,4'-diphenolsulfone,
3,3'-diallyl-4,4'-diphenolsulfone,
α,α-bis (4-hydroxyphenyl)-α-methyltoluene,
tetrabromobisphenol A,
tetrabromobisphenol S,
4,4'-thiobis(2-methylphenol),
4,4'-thiobis(2-chlorophenol), antipyrine complex of zinc thiocyanate, and the like.

The coloring layer preferably includes a binder resin to securely fix the coloring agent and the color developer on a substrate.

Specific examples of such a binder resin include, but are not limited thereto:

water-soluble resins such as polyvinyl alcohol, starch and its derivatives, cellulose derivatives (e.g., hydroxymethyl cellulose, hydroxyethyl cellulose, carboxymethyl cellulose, methyl cellulose, ethyl cellulose, and the like), polyacrylic acid sodium salt, polyvinylpyrrolidone, acrylamide-acrylate copolymers, acrylamide-acrylate-methacrylic acid copolymers, alkali metal salts of styrene-maleic anhydride copolymers, alkali metal salts of isobutylene-maleic anhydride copolymers, polyacrylamide, sodium alginate, gelatin, casein and the like; emulsions of resins such as polyvinyl acetate, polyurethane, polyacrylic acid, polyacrylate, vinyl chloride-vinyl acetate copolymers, polybutyl methacrylate, ethylene-vinyl acetate copolymers, styrene-butadiene-acryl copolymers and the like.

The thermosensitive recording material of the present invention may include a thermofusible material, which serves as a thermosensitivity improving agent. The content of the thermofusible material should be controlled so that the image density of the recording material when heated by being brought into contact with a heated block at a temperature of 150° C. is 0.1 or more lower than the maximum image density of the recording material.

Specific examples of the thermofusible material include the following compounds, but are not limited thereto:

fatty acids such as stearic acid and behenic acid; amides such as stearic acid amide and palmitic acid amide; fatty acid metal salts such as zinc stearate, aluminum stearate, calcium stearate, zinc palmitate and zinc behenate; p-benzylbiphenyl, m-terphenyl, triphenyl methane, benzyl p-benzyloxybenzoate, β-benzyloxynaphthalene, phenyl β-naphthoate, phenyl 1-hydroxy-2-naphthoate, methyl 1-hydroxy-2-naphthoate, diphenyl carbonate, dibenzyl terephthalate, dimethyl terephthalate, 1,4-dimethoxynaphthalene, 1,4-ethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio) ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy) biphenyl, p-aryloxybiphenyl, p-propagyloxybiphenyl, dibenzoyloxymethane, dibenzoyloxypropane, dibenzyldisulfide, 1,1-diphenylethanol, 1,1-diphenylpropanol, p-benzyloxybenzylalcohol, 1,3-diphenoxy-2-propanol, N-octadecylcarbamoyl-p-methoxycarbonylbenzene, N-octadecylcarbamoylbenzene, 1,2-bis(4-methoxyphenoxy)propane, 1,5-bis(4-methoxyphenoxy)-3-oxapentane, dibenzyl oxalate, bis(4-methylbenzyl)oxalate, bis(4-chlorobenzyl)oxalate, and the like.

The coloring layer of the recording material of the present invention may further include auxiliary agents such as fillers, surfactants, lubricants, and agents preventing the recording layer from coloring upon application of pressure.

Suitable fillers for use in the coloring layer include inorganic fillers such as calcium carbonate, silica, zinc oxide, titanium oxide, aluminum hydroxide, zinc hydroxide, barium sulfate, clay, kaolin, talc, calciumcarbonate and silica which are subjected to a surface treatment, and the like; and organic fillers such as fine powders of resins, i.e., urea-formaldehyde resins, styrene-methacrylic acid copolymers, polystyrene resins, vinylidene chloride resins and the like. These fillers can be employed alone or in combination so that the oil absorption of the fillers used is optimized.

Specific examples of the lubricant include fatty acids and their salts, fatty acid amides, fatty acid esters, animal waxes, vegetable waxes, mineral waxes, petroleum waxes, and the like.

The intermediate layer of the present invention preferably includes a hollow filler (an organic mid-air filler). Suitable hollow fillers include micro hollow fillers which previously foamed and whose shell includes a thermoplastic resin. The average particle diameter thereof is from about 1 to about 10 μm to save manufacturing cost and to prepare a recording material having a smooth surface by which good thermosensitivity can be obtained. It is preferable to use a hollow filler in which the scatter in the particle diameter of the particles is small, i.e., whose particle diameter is uniform.

The hollow fillers preferably have a hollow rate of from about 60 to about 98%, and preferably not less than about 90%, to prepare a recording material having a good heat insulation property, i.e., good thermosensitivity. Namely, when a recording material has a good heat insulation property, the heat energy supplied to the recording material can be effectively used for printing images, and therefore the recording material has good thermosensitivity. The hollow rate is defined as follows:

$$\text{Hollow rate (\%)}=(ID/OD)\times 100$$

wherein ID is an inside diameter of a hollow filler and OD is an outside diameter of the hollow particle.

Suitable thermoplastic resins for use as the shell of the hollow fillers include thermoplastic resins such as polystyrene, polyvinyl chloride, polyvinylidene chloride, polyvinyl acetate, polyacrylate, polyacrylonitrile, polybutadiene, and their copolymers. Among these resins, copolymers including vinylidene chloride and acrylonitrile as main constituents are preferable.

The intermediate layer can be formed by the following method, but the method is not limited thereto:

(1) a hollow filler is dispersed in water together with a binder resin such as a known water-soluble resin or an aqueous resin emulsion to prepare an intermediate layer coating liquid; and (2) the coating liquid is coated on a substrate and then dried to form an intermediate layer.

The coating weight of the intermediate layer is not less than about 1 g/m$^2$, and preferably from about 2 g/m$^2$ to about 15 g/m$^2$. The content of the binder resin in the intermediate layer is preferably from about 2 to about 50% by weight per total weight of the binder resin and the hollow filler to maintain good adhesion of the substrate and the intermediate layer.

Suitable binder resins for use in the intermediate layer include known water soluble resins and resin emulsions. Specific examples of such water soluble resins include polyvinyl alcohol; starch and derivatives thereof; cellulose derivatives such as methoxy cellulose, hydroxyethyl cellulose, carboxymethyl cellulose, methyl cellulose and ethyl cellulose; polyacrylic acid sodium salts; polyvinyl pyrrolidone; acrylamide-acrylate copolymers; acrylamide-acrylate-methacrylic acid copolymers; styrene-maleic anhydride alkali metal salts; isobutylene-maleic anhydride alkali metal salts; polyacrylamide; sodiumalginate; gelatin; casein; and the like.

Specific examples of the resin emulsions include latexes of styrene-butadiene copolymers, styrene-butadiene-acryl copolymers and the like; and emulsions of vinyl acetate, vinyl acetate-acrylic acid copolymers, styrene-acrylate copolymers, acrylic resins, polyurethane resins and the like.

The thermosensitive recording material of the present invention may include a protective layer which is formed overlying the coloring layer to improve an ability to be used with thermal printheads, preservability of recorded images, a writing ability (an ability of the recording material to be easily written with various writing implements), a stamp receiving ability and the like.

The protective layer mainly includes a resin. Specific examples of the resin include water-soluble resins such as polyvinyl alcohol, cellulose derivatives, starch and its derivatives, carboxyl-modified polyvinyl alcohol, polyacrylic acid and its derivatives, styrene/acrylic acid copolymers and their derivatives, poly(meth)acrylamide and their derivatives, styrene/acrylic acid/acryl amide copolymers, amino-modified polyvinyl alcohols, epoxy-modified polyvinyl alcohols, polyethylene imine, water soluble polyester resins, water soluble polyurethane resins, isobutylene/maleic anhydride copolymers and their derivatives; and other polymers such as polyester resins, polyurethane resins, acrylic acid ester copolymers, styrene/acrylate copolymers, epoxy resins, polyvinyl acetate resins, poly vinylidene chloride resins, polyvinyl chloride resins, and the like. Among these resins, water soluble resins are preferable.

The protective layer may include auxiliary agents such as fillers, surfactants, thermofusible materials (or lubricants), agents for preventing color formation of the recording material upon application of pressure, and the like. Specific examples of the fillers and thermofusible materials include the fillers and thermofusible materials mentioned above for use in the coloring layer.

The thermosensitive recording material of the present invention may have a print layer, a magnetic layer and the like thereon.

The thermosensitive recording material of the present invention can be manufactured by any known method. For example, a method is typically used in which coating liquids for the layers mentioned above are coated one by one on a substrate such as paper, plastic films and the like and then dried. The thermosensitive recording material is preferably subjected to a calender treatment to improve the ability to be used with thermal printheads. The calender treatment may be performed to the intermediate layer, coloring layer and/or protective layer. The calender treatment is performed so that the calendered surface has a predetermined smoothness. By controlling surface smoothness of the recording material, images with good resolution and without background fouling can be obtained.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed and dispersed with a sand mill so that the solid components of each coating liquid had an average particle diameter not greater than 1.5 $\mu$m.

Formation of Liquid A

| | |
|---|---|
| 3-dibutylamino-6-methyl-7-anilinofluorane | 20 |
| Polyvinyl alcohol (10% aqueous solution) | 20 |
| Water | 60 |

Formulation of Liquid B

| | |
|---|---|
| Bis(4-hydroxy-3,5-dibromophenyl) sulfone (melting point of about 290° C.) | 4 |
| Di(p-methylbenzyl) oxalate | 4 |
| Polymer mainly consisting of 4,4'-[oxybis(ethyleneoxy-p-phenylenesulfonyl)]diphenol | 4 |
| Silica (oil absorption of 130 ml/100 g) | 8 |
| Polyvinyl alcohol including an acetoacetyl group (10% aqueous solution) | 20 |
| Water | 60 |

Formulation of Liquid C

| | |
|---|---|
| Silica | 15 |
| Polyvinyl alcohol (10% aqueous solution) | 15 |
| Water | 70 |

Thus Liquids A, B, and C were prepared.

The following components were mixed to prepare an intermediate layer coating liquid D.

Formulation of Intermediate Layer Coating Liquid D

| | |
|---|---|
| Dispersion of spherical plastic hollow filler (hollow rate of 90%, solid content of 40%) | 25 |
| Latex of styrene/butadiene copolymer (solid content of 50%) | 20 |
| Water | 55 |

The intermediate layer coating liquid D was coated on one side of a paper sheet having a basis weight of 80 g/m$^2$ and dried to form an intermediate layer having a coating weight of 3.5 g/m$^2$ on a dry basis.

The following components were mixed to prepare a coloring layer coating liquid E.

Formulation of Liquid E

| | |
|---|---|
| Liquid A | 9.1 |
| Liquid B | 90.9 |

Liquid E was coated on the intermediate layer and dried to prepare a coloring layer having a coating weight of 6 g/m$^2$ on a dry basis.

The following components were mixed to prepare a protective layer coating liquid F.

Formulation of Protective Layer Coating Liquid F

| | |
|---|---|
| Liquid C | 16.7 |
| Polyyinyl alcohol (10% aqueous solution) | 50 |
| Polyamide epichlorohydrin (12.5% aqueous solution) | 14 |
| Dispersion of zinc stearate (solid content of 30%) | 2.5 |
| Water | 16.8 |

The protective layer coating liquid F was coated on the coloring layer and dried to prepare a protective layer having a coating weight of 1.5 g/m$^2$ on a dry basis.

The paper sheet having the intermediate layer, coloring layer and protective layer thereon was then subjected to a calender treatment such that the surface smoothness of the protective layer was from 1500 to 2500 sec in Bekk smoothness.

Thus a thermosensitive recording material of the present invention was prepared.

Example 2

The procedure for preparation of the thermosensitive recording material in Example 1 was repeated except that 3-dibutylamino-6-methyl-7-anilinofluoran in Liquid A was replaced with 20 parts by weight of 3-N-ethyl-N-p-tolylamino-6-methyl-7-anilinofluoran and Liquid B was replaced with the following Liquid G.

Formulation of Liquid G

| | |
|---|---|
| Bis(4-hydroxy-3,5-dibromophenyl) sulfone (melting point of about 290° C.) | 4 |
| 2,4-hydroxydiphenylsulfone | 2 |
| Polymer mainly consisting of 4,4'-[oxybis(ethyleneoxy-p-phenylenesulfonyl)]diphenol | 6 |
| Silica (oil absorption of 130 ml/100 g) | 6 |
| Polyvinyl alcohol having an acetoacetyl group (10% aqueous solution) | 17 |
| Water | 61 |

Thus a thermosensitive recording material of the present invention was prepared.

Example 3

The procedure for preparation of the thermosensitive recording material in Example 1 was repeated except that di(p-methylbenzyl) oxalate in Liquid B was replaced with 4 parts by weight of water.

Thus a thermosensitive recording material of the present invention was prepared.

Example 4

The procedure for preparation of the thermosensitive recording material in Example 1 was repeated except that the dispersion of a spherical plastic hollow filler in Liquid D was replaced with 25 parts by weight of a dispersion of a spherical plastic hollow filler (hollow rate of 30%, solid content of 40%).

Thus a thermosensitive recording material of the present invention was prepared.

Comparative Example 1

The procedure for preparation of the thermosensitive recording material in Example 1 was repeated except that the silica having an oil absorption of 130 ml/100 g in Liquid B was replaced with 8 parts by weight of aluminum hydroxide having an oil absorption of 45 ml/100 g.

Thus a comparative thermosensitive recording material was prepared.

Comparative Example 2

The procedure for preparation of the thermosensitive recording material in Example 3 was repeated except that the bis(4-hydroxy-3,5-dibromophenyl)sulfone having a melting point of about 290° C. in Liquid B was replaced with 4 parts by weight of 4,4'-methylenebis(oxyethylenethio)diphenol having a melting point of about 107° C.

Thus a comparative thermosensitive recording material was prepared.

The thermosensitive recording materials of the present invention prepared in Examples 1 to 4 and the comparative thermosensitive recording materials prepared in Comparative Examples 1 to 2 were evaluated by the following methods.

(1) Practical Image Density (Dynamic Image Density)

Black solid images were formed in a thermosensitive recording material using a thermal recording simulator manufactured by Ohkura Electric Co., Ltd.

The recording conditions were as follows:

| | |
|---|---|
| Recording energy | 0.45 mJ/dot |
| (power of a thermal printhead | 0.45 W/dot) |
| (pulse width | 1.0 ms) |
| Scanning density | 8 × 7.7 dot/mm |

The image density of each image was measured with a reflection densitometer (RD-914 with a #106 filter, manufactured by Macbeth Co.).

(2) Static Image Density

Two blocks heated at 150° C. and 140° C. were contacted with the surface of each thermosensitive recording material for 1 second under a pressure of 2 kg/cm$^2$. The image density was also measured with the reflection densitometer RD-914.

(3) Image Recognizability

A checkered pattern image was recorded on each thermosensitive recording material under the recording conditions mentioned in paragraph (1), and then a heated block at a temperature of 150° C. was brought into contact with the image for 1 second under a pressure of 2 kg/cm$^2$. The checkered image was visually observed to determine whether the image can be recognized.

The results are shown in Table 1.

TABLE 1

| | Practical image density | Static image density 140° C. | Static image density 150° C. | Image recognizability |
|---|---|---|---|---|
| Example 1 | 1.42 | 1.21 | 1.25 | recognizable |
| Example 2 | 1.42 | 0.76 | 1.08 | recognizable |
| Example 3 | 1.31 | 0.34 | 0.50 | recognizable |
| Example 4 | 1.32 | 1.15 | 1.19 | recognizable |
| Comparative Example 1 | 1.39 | 1.35 | 1.37 | unrecognizable |
| Comparative Example 2 | 1.40 | 1.40 | 1.42 | unrecognizable |

As can be understood from Table 1, the thermosensitive recording material has good heat resistance such that images formed therein can be read even when the images contacts a heat source at a temperature of 150° C.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 10-194471, filed on Jul. 9, 1998, the entire contents of which are herein incorporated by reference.

What is claimed is:

1. A thermosensitive recording material comprising a coloring layer which is formed overlying a substrate and which comprises a leuco dye and a color developer which can make the leuco dye color upon application of heat, wherein the thermosensitive recording material has a thermal property such that the coloring layer achieves a colored state having an image density (1) not lower than about 1.20 when the coloring layer is heated with a thermal printhead upon application of a recording energy of 0.45 mJ/dot, and the coloring layer achieves a colored state having an image density (2) which is not less than about 0.1 lower than the image density (1) when the coloring layer is heated by being brought into contact with a heated block at a temperature of 150° C. for 1 second upon application of a pressure of 2 kg/cm$^2$, the coloring layer further comprising a pigment having an oil absorption of from about 130 ml/100 g to about 200 ml/100 g, and at least one of the leuco dye and the color developer having a melting point not less than about 180° C.

2. The thermosensitive recording material according to claim 1, wherein the image density (1) is not lower than about 1.35.

3. The thermosensitive recording material according to claim 1, wherein the thermosensitive recording material further has a thermal property such that the coloring layer achieves a colored state having an image density (3) at least about 0.1 lower than image density (1) but not lower than about 1.00 when the coloring layer is heated by being brought into contact with a heated block at a temperature of 140° C. for 1 second upon application of a pressure of 2 kg/cm$^2$.

4. The thermosensitive recording material according to claim 1, wherein the thermosensitive recording material further comprises an intermediate layer formed between the substrate and the coloring layer and comprising a hollow filler which has a hollow rate of from about 60 to about 98% and a volume average particle diameter of from about 1 to about 10 $\mu$m.

5. The thermosensitive recording material according to claim 4, wherein the hollow filler has a shell comprising a thermoplastic resin.

6. The thermosensitive recording material according to claim 5, wherein the thermoplastic resin comprises a copolymer having repeating units of vinylidene chloride and acrylonitrile.

7. The thermosensitive recording material according to claim 1, wherein the thermosensitive recording material further has a print layer at least on one side thereof.

8. The thermosensitive recording material according to claim 1, wherein the pigment is present in an amount of from 3 to 6 parts by weight per 1 part by weight of the leuco dye.

9. The thermosensitive recording material according to claim 8, wherein the pigment comprises silica.

10. The thermosensitive recording material according to claim 8, wherein the coloring layer further comprises at least one of a dye and a color developer having a melting point not greater than 180° C.

11. The thermosensitive recording material according to claim 1, wherein the coloring layer further comprises at least one of a dye and a color developer having a melting point not greater than 180° C.

12. The thermosensitive recording material according to claim 1, further comprising a thermofusible material as a thermosensitivity imparting agent.

* * * * *